US011247112B1

(12) United States Patent
Weinhardt

(10) Patent No.: US 11,247,112 B1
(45) Date of Patent: Feb. 15, 2022

(54) SOFTBALL/HARDBALL THROWING MACHINE

(71) Applicant: Joel Weinhardt, Leesburg, FL (US)

(72) Inventor: Joel Weinhardt, Leesburg, FL (US)

( * ) Notice: Subject to any disclaimer, the term of this patent is extended or adjusted under 35 U.S.C. 154(b) by 42 days.

(21) Appl. No.: 16/950,947

(22) Filed: Nov. 18, 2020

(51) Int. Cl.
*A63B 69/40* (2006.01)
*A63B 69/00* (2006.01)

(52) U.S. Cl.
CPC ..... *A63B 69/409* (2013.01); *A63B 69/0002* (2013.01); *A63B 2069/0008* (2013.01)

(58) Field of Classification Search
CPC ..... A63B 69/409; A63B 69/0002; A63B 2069/0008
See application file for complete search history.

(56) References Cited

U.S. PATENT DOCUMENTS 2,526,018 A * 10/1950 Foster ..... A63B 69/409 124/73
3,584,614 A * 6/1971 Horvath ..... A63B 69/409 124/56
3,847,132 A * 11/1974 Schatz ..... A63B 69/409 124/82
3,855,988 A * 12/1974 Sweeton ..... A63B 69/409 124/56
3,911,888 A * 10/1975 Horvath ..... A63B 69/409 124/56
3,990,426 A * 11/1976 Stokes ..... A63B 69/409 124/56
5,887,578 A * 3/1999 Backeris ..... F41B 11/57 124/49
6,672,297 B1 * 1/2004 Liao ..... A63B 69/0002 124/6
2016/0206942 A1 * 7/2016 Smith, Jr. ..... A63B 69/0002
2020/0171336 A1 * 6/2020 Brown, Jr. ..... A63B 23/03508

* cited by examiner

*Primary Examiner* — Jeffrey S Vanderveen

(74) *Attorney, Agent, or Firm* — Furr Law Firm; Jeffrey Furr, Esq.

(57) ABSTRACT

The current invention is a throwing machine for softballs or hardball (baseball). It comprises a loading tube, a loader, a pressure means, a locking pin and a throwing tube. The throwing machine is placed on a frame with a set of wheels in the preferred embodiment.

10 Claims, 2 Drawing Sheets

SOFTBALL/HARDBALL THROWING MACHINE

CROSS-REFERENCES TO RELATED APPLICATIONS (IF ANY)

None.

BACKGROUND

1. Field of the Invention

This invention relates to Softball/Hardball Throwing Machine and particularly ones that are easy to set up and use.

2. Description of Prior Art

Softball and baseball have been an American pastime which is only growing in interest. There is a need to players to gain skillsets for the game. Currently it ties up a coaches time to coach players to field balls and currently there is not a machine that can both pitch and train the players in the outfield.

There is still room for improvement in the art.

SUMMARY OF THE INVENTION

The current invention is a throwing machine for softballs or hardball (baseball). It comprises a loading tube, a loader, a pressure means, a locking pin and a throwing tube. The throwing machine is placed on a frame with a set of wheels in the preferred embodiment.

BRIEF DESCRIPTION OF THE DRAWINGS

Without restricting the full scope of this invention, the preferred form of this invention is illustrated in the following drawings.

DESCRIPTION OF THE PREFERRED EMBODIMENT

There are a number of significant design features and improvements incorporated within the invention.

Figure 1:
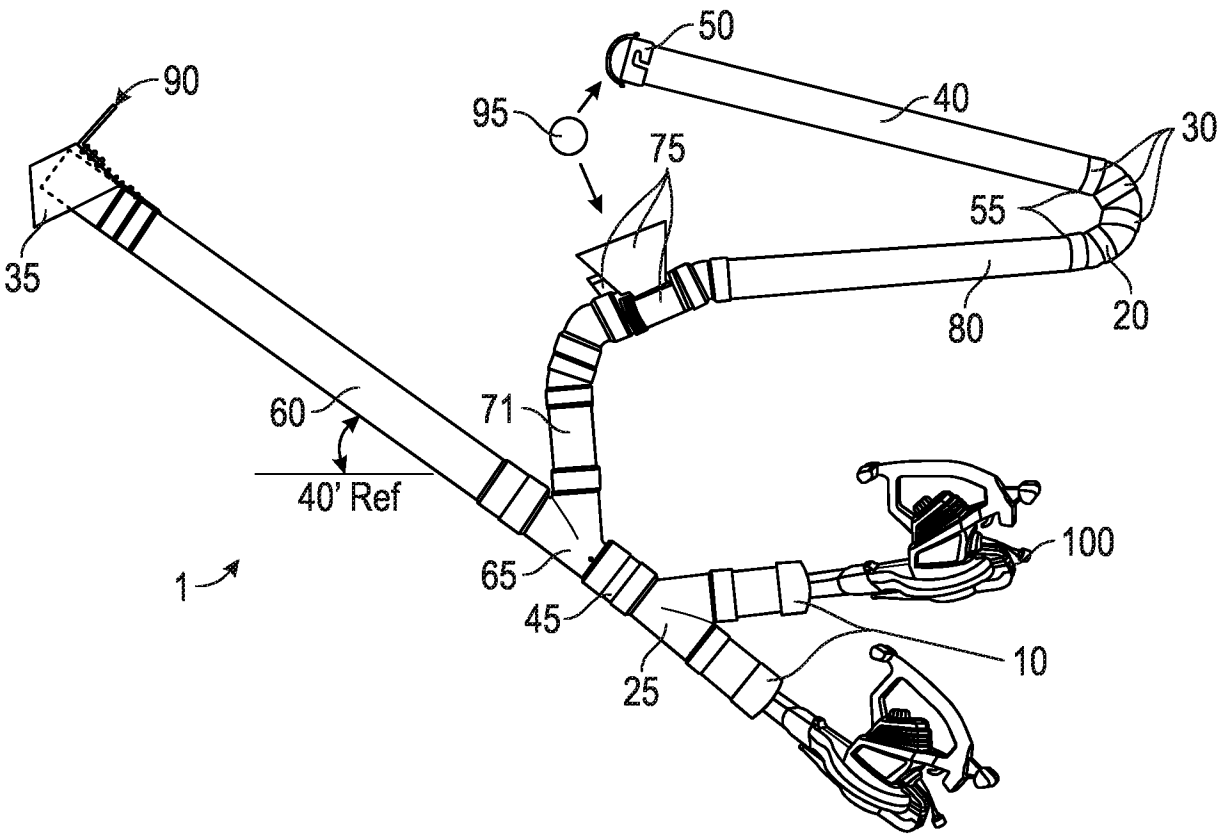
FIG. 1 shown the configuration of the throwing machine.
Figure 2:
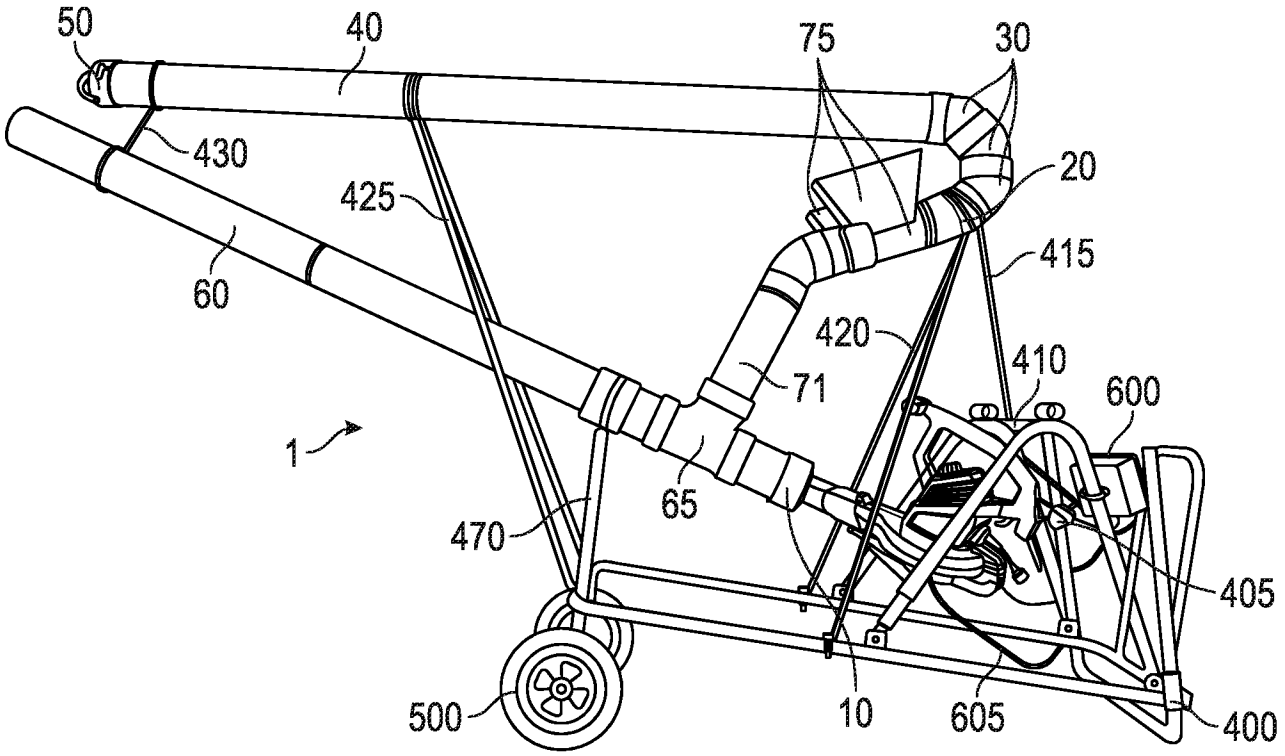
FIG. 2 is the throwing machine on its wheeled base.

The current invention is an innovative softball and hardball (baseball) thrower 1 as shown in FIGS. 1 through 2.

The current invention mimics a long high ball into center field. The teams can run toward it and practice keeping their eye on the ball to make running catches. The current invention can also double as a pitching machine.

The throwing machine 1, shown in FIGS. 1 and 2, is an invention, on a frame with a set of wheels in the preferred embodiment that throws softballs or hardballs 95 into a high arc for outfield practice. It comprises a loading tube 80, a feeding/timing device (ball feeder) 75, an antijam pin 45, a pressure means 100, and a throwing barrel 60.

The throwing machine 1 mimics a long high ball into center field. The teams can run toward it and practice keeping their eye on the ball to make running catches.

In the preferred method, the pressure means 100 is an air blower which can be similar to a leaf blower. The pressure means 100 can be connected to an electric outlet using an electric box 600 or through a power cable 605 to an outlet or can be powered by batteries or a gasoline or other type of motor.

The device would have a loading means such a feeder magazine 75. There would be a feeding devise which would feed a single ball at a time into. The throwing barrel 60 has an antijam pin 45 at the inlet end 25 to make sure that the balls 95 do not flow into the pressure means 100 when it is turned off. When the ball 95 falls into the throwing barrel 60 the pressure means 100 will force the ball 95 down the barrel 60 and out of the barrel 60 with sufficient force to eject the ball out of the end 90 of barrel and into the air. The barrel 60 has an inner circumference slightly larger than the diameter of the balls 95 being used. So the barrel 60 would have a different circumference for softballs versus hardballs.

The barrel 60 extends straight from the pressure means 100. The pressure means 100 is connected to the barrel 60 by a barrel connection end 10 which has a small opening into which the pressure means 100 fits. The barrel 60 has an opening 90 through which the ball 95 is throw out of the barrel 95. The end 90 can have an end cap 35 which covers and protects the end 90 preventing rain or debris from entering the barrel 60.

The barrel 60 has a feeder tube connector 65 which connects the feeder tube 80 to the barrel 60. A ball feeder 75 is attached to the feeder tube 80. The throwing feeder 75 is an opening into the feeder tube 80 into which the balls 95 are dropped. In the preferred embodiment, the ball feeder 75 has sides that extend out from the opening.

The barrel 60 would have an antijam pin 45 that would be positioned between the feeder tube connector 65 and the barrel connection end 10. The antijam pin 45 prevents the balls from following into the barrel connection end 10 when the pressure means 100 is turned off.

The feeder tube 80 is comprised of a number of components. The feeder tube 80 has a ball feeder tube 71 which connects the ball feeder 75 to the feeder tube connector 65. In the preferred embodiment it is connected to the ball feeder 75 with a slight backward curve placing the ball feeder at approximately 30 degree angle. The feeder tube 80 extends straight back from the ball feeder 75 and then has a curve 30. The curve 30 places the feeder tube 80 a 180 degrees forward with a forward magazine tube 40 that has a removable cap 50.

The feeder tube 80 will have an end tube cap 50 at the end of the tube which closes the end of the feeder tube 80. The feeder tube 80 curves forward using curve connections 30 with the forward magazine tube 40 with the removable cap 50 at the end.

The balls 95 can be loaded singularly into the ball feeder 75 or into the feeder tube 80 by removing the removable cap 50 and placing the balls into the forward magazine tube 40 to be loaded into the ball feeder 75. Multiple balls 95 can be loaded into the magazine component of the feeder tube.

The ball feeder 75 can be set to a timing mechanism which can be mechanical or electrical to release a ball 95 into the barrel 60 at a set time intervals. These types of devices are well know in the industry. The balls 95 are gravity feed into the barrel 60.

In an alternate embodiment, the throwing device 1 can have multiple pressure means 100 which are connected to the barrel 60 have a combining joint 25 as shown in FIG. 1.

As shown in FIG. 2, in the preferred embodiment, the throwing device 1 would sit on a base 400 which would be able to adjust the position of the throwing device 1 and would have wheels 500 attached to the base 400 that could be used to move the device 1.

The wheels 500 will extend down from the front of the base 400. A handle 460 will extend up from the back of the base 400. Two pressure means brackets 410 will extend up from the sides of the base 400 to hold the pressure means 100 in place and allow it to change positions to change the placement of the ball 95 when the ball 95 is pressured out.

The base 400 will have a plurality of support bars that hold up and support the throwing device 1. In the preferred embodiment there will be a pair of front support bars 425 which support the front upper loading tube 40. There will be a pair of shorter support bars 470 that support the throwing barrel 60. A pair of mid supports 420 and connect the base 400 to the loading tube 80. A loading tube support rod 415 also connects to the loading tube 80 to the back of the base 400.

The throwing device 1 can be set up as a kit with all of the main component being detachable and can be reassembled. It can be broken down into its subcomponents for easier storage and transport.

Although the present invention has been described in considerable detail with reference to certain preferred versions thereof, other versions are possible. Therefore, the point and scope of the appended claims should not be limited to the description of the preferred versions contained herein.

As to a further discussion of the manner of usage and operation of the present invention, the same should be apparent from the above description. Accordingly, no further discussion relating to the manner of usage and operation will be provided. With respect to the above description, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

That which is claimed is:

1. A ball throwing device comprising:

a feeder tube attached to a ball feeder which is attached to a barrel which is open on one end and a pressure means where the feeder tube has a ball feeder tube which connects the ball feeder to the feeder tube connector connected to the ball feeder with a slight backward curve where the feeder tube extends straight back from the ball feeder and then has a curve that places the feeder tube 180 degrees forward with a forward magazine tube that has a removable cap where the feeder tube has a removable end tube cap at the end of the feeder tube which closes the end of the feeder tube, having a barrel connection end with an opening for the pressure means with an antijam pin at an inlet end to make sure that balls do not flow into the pressure means.

2. A ball throwing device according to claim 1 further comprising:

where the pressure means is an air blower.

3. A ball throwing device according to claim 1 further comprising:

where the feeder tube is attached to the barrel by a feeder tube connector.

4. A ball throwing device according to claim 3 further comprising:

where the ball feeder is connected to the feeder tube connector.

5. A ball throwing device according to claim 1 further comprising:

the ball feeder feeding balls into the feeder tube.

6. A ball throwing device according to claim 5 further comprising:

has a timing mechanism.

7. A ball throwing device according to claim 1 further comprising:

having an adjustable base.

8. A ball throwing device according to claim 7 further comprising:

having wheels attached to the base.

9. A ball throwing device according to claim 7 further comprising:

having a handle attached to the base.

10. A ball throwing device according to claim 7 further comprising: two pressure means brackets will extend up from the sides of the base to hold the pressure means in place and allow it to change positions, a pair of front support bars ehich support the front upper loading tube, a pair of shorter support bars that support the throwing barrel, a pair of mid supports that connect the base to the loading tube and a loading tube support rod that connects the loading tube to the back of the base.

* * * * *